US011529820B2

(12) United States Patent
Kao et al.

(10) Patent No.: US 11,529,820 B2
(45) Date of Patent: Dec. 20, 2022

(54) METHOD FOR MANUFACTURING WEAR AND TEAR-INDICATING PRODUCT

(71) Applicant: Simple Green Co., Ltd., Huatan Township, Changhua County (TW)

(72) Inventors: Chen-I Kao, Huatan Township (TW); Glenn Malcolm Boghosian, Beverly Hills, CA (US); Chen-Ju Lai, Taipei (TW); Shang-Chieh Kao, Huatan Township (TW); Shu-Chen Huang, Huatan Township (TW); Yu-Jen Pan, Changhua (TW); Yong-Han Shin, Hemei Township (TW)

(73) Assignee: SIMPLE GREEN CO., LTD., Huatan Township (TW)

( * ) Notice: Subject to any disclaimer, the term of this patent is extended or adjusted under 35 U.S.C. 154(b) by 59 days.

(21) Appl. No.: 16/394,150

(22) Filed: Apr. 25, 2019

(65) Prior Publication Data

US 2019/0248167 A1 Aug. 15, 2019

Related U.S. Application Data

(63) Continuation-in-part of application No. 15/398,862, filed on Jan. 5, 2017, now abandoned.

(30) Foreign Application Priority Data

Mar. 1, 2016 (TW) ..... 105106047

(51) Int. Cl.
*B41M 5/382* (2006.01)
*B41M 5/035* (2006.01)

(52) U.S. Cl.
CPC ..... *B41M 5/38235* (2013.01); *B41M 5/0355* (2013.01)

(58) Field of Classification Search
None
See application file for complete search history.

(56) References Cited

U.S. PATENT DOCUMENTS 3,971,145 A * 7/1976 Stegerwald ..... A43B 5/10 36/32 R
8,663,416 B2 3/2014 Dolsey et al.
(Continued)

FOREIGN PATENT DOCUMENTS

CN 1145505 A 3/1997
CN 2372136 Y 4/2000
(Continued)

*Primary Examiner* — Joshua D Zimmerman
(74) *Attorney, Agent, or Firm* — Cheng-Ju Chiang

(57) ABSTRACT

A method for manufacturing a wear and tear-indicating product includes mixing an elastomeric material, an ink affinitive material and an ink repulsive material, followed by molding to obtain an ink receiving sheet; disposing a sublimation transfer paper including a sublimation ink on the ink receiving sheet; heat pressing the sublimation transfer paper, so that the sublimation ink is released from the sublimation transfer paper and permeates into the ink receiving sheet, so as to obtain a colored ink receiving sheet formed with multiple color indicating areas that contain the ink affinitive material and sublimation ink permeating thereinto; removing the sublimation transfer paper from the colored ink receiving sheet.

12 Claims, 6 Drawing Sheets

(56) References Cited

U.S. PATENT DOCUMENTS

| | | | | |
|---|---|---|---|---|
| 2009/0270545 | A1* | 10/2009 | Sahnoune | C08L 23/142<br>524/476 |
| 2012/0180919 | A1 | 7/2012 | Larregain et al. | |
| 2015/0367612 | A1 | 12/2015 | Weiss et al. | |

FOREIGN PATENT DOCUMENTS

| | | | | | |
|---|---|---|---|---|---|
| CN | 204129829 | U | | 1/2015 | |
| CN | 103818136 | B | | 1/2016 | |
| CN | 205818737 | U | * | 12/2016 | |
| JP | 2015182397 | A | | 10/2015 | |
| WO | WO-2004106082 | A1 | * | 12/2004 | D06P 5/003 |
| WO | 103529041 | A | | 1/2014 | |
| WO | 2015046556 | A1 | | 4/2015 | |

* cited by examiner

METHOD FOR MANUFACTURING WEAR AND TEAR-INDICATING PRODUCT

CROSS-REFERENCE TO RELATED APPLICATION

This application is a continuation-in-part application of U.S. patent application Ser. No. 15/398,862 (filed on Jan. 5, 2017), which claims priority of Taiwanese Patent Application No. 105106047 (filed on Mar. 1, 2016). This application claims the benefits and priority of all these prior applications and incorporates by reference the contents of these prior applications in their entirety.

FIELD

The present disclosure relates to a method for manufacturing a printed product, and more particularly to a method for manufacturing a wear and tear-indicating product.

BACKGROUND

A transfer printing method comprises preparing a medium film with various figures, and then transferring the medium film to a surface of an object by a determined pressure. The most popular transfer printing method utilizes heat transfer technology, in which patterns or figures of an ink layer is printed and transferred onto a heatproof substrate to produce a printed product. The heat transfer technology is available for various products, such as electric appliances, common commodities, decorative items, and the like. The thus produced printed products are resistant to erosion, impact, aging, wear and fade, and are fireproof, thereby enhancing the versatility of the heat transfer technology. In practice, the patterns or figures are directly transferred to the surface of a product by the heat transfer technology to enhance the appearance of the printed product and thus, satisfying the needs of customers. However, a user is unable to evaluate the entire wear condition of the printed product for long-term usage.

SUMMARY

Therefore, an objective of the present disclosure is to provide a method for manufacturing a wear and tear-indicating product that can alleviate at least one of the drawbacks of the prior art.

According to this disclosure, the method includes the steps of:

- mixing an elastomeric material, an ink affinitive material and an ink repulsive material under stirring to form a blank, followed by molding the blank, so as to obtain an ink receiving sheet;
- disposing a sublimation transfer paper on the ink receiving sheet, the sublimation transfer paper including a sublimation ink deposited thereon;
- heat pressing the sublimation transfer paper on the ink receiving sheet, so that the sublimation ink is released from the sublimation transfer paper, and permeates into the ink receiving sheet so as to obtain a colored ink receiving sheet, the concentration of the sublimation ink in the ink affinitive material being higher than that in the ink repulsive material, the colored ink receiving sheet having a plurality of color indicating areas that contains the ink affinitive material and the sublimation ink permeating into the ink affinitive material; and
- removing the sublimation transfer paper from the colored ink receiving sheet so as to obtain the wear and tear-indicating product.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
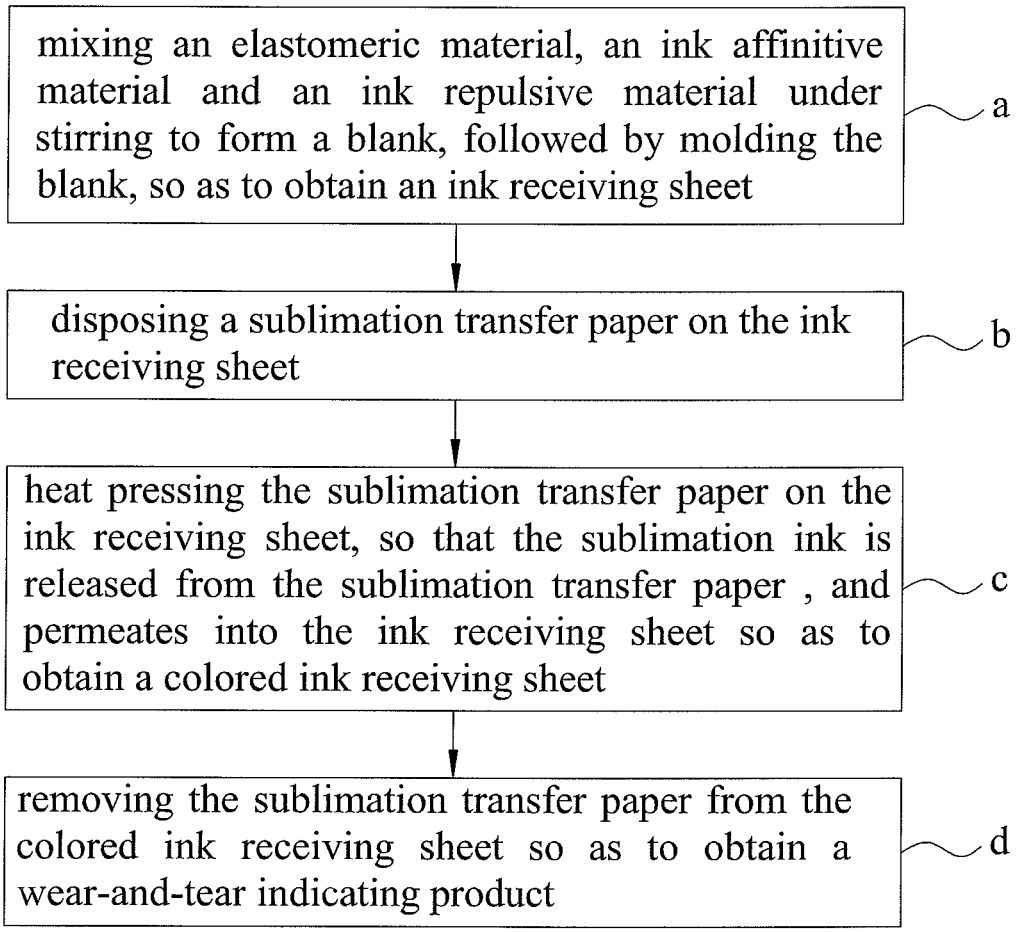
FIG. 1 is a flow chart illustrating an embodiment of a method for manufacturing a wear and tear-indicating product according to the disclosure.

Referring to FIG. 1, a method for manufacturing a wear and tear-indicating product in accordance with an embodiment of the present disclosure includes the following steps a to d.

Figure 2:
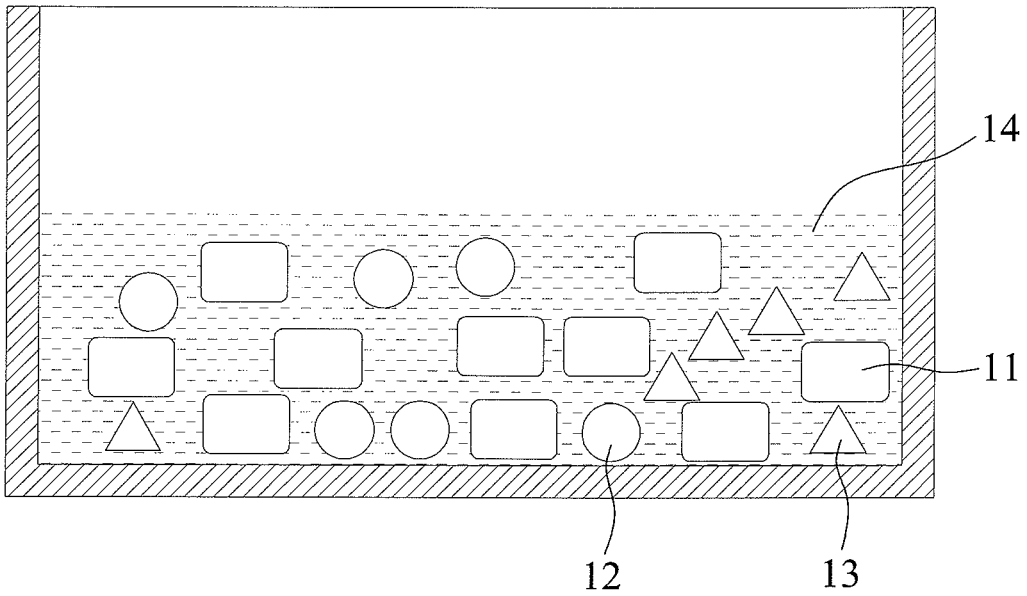
FIGS. 2 to 6 are schematic views illustrating consecutive steps of the method of FIG. 1.
Figure 3:
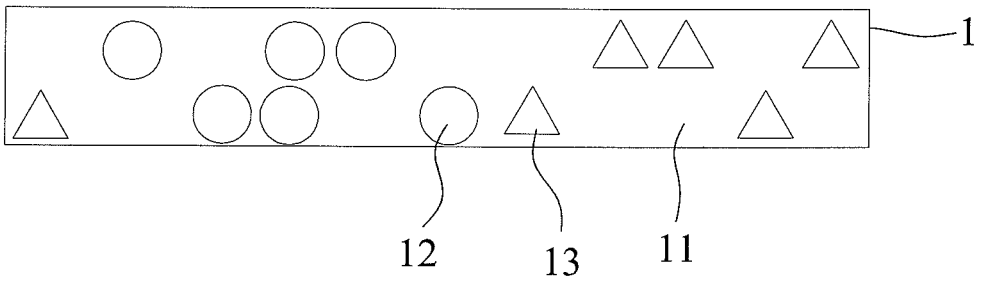

In Step a, an elastomeric material 11, an ink affinitive material 12 and an ink repulsive material 13 are mixed under stirring to form a blank, followed by molding the blank so as to obtain an ink receiving sheet 1 (see FIGS. 2 and 3).

Examples of the elastomeric material 11 suitable for use in this disclosure may include, but are not limited to, natural rubber, synthetic rubber, thermoplastic elastomer (TPE) and combinations thereof. Examples of the synthetic rubber include, but are not limited to, unsaturated rubbers, such as styrene-butadiene rubber (SBR), polybutadiene rubber (BR), nitrile butadiene rubber (NBR), isoprene rubber (IR), etc.; and saturated rubbers, such as ethylene-vinyl acetate (EVA), ethylene propylene rubber (EPM), etc.

Examples of the thermoplastic elastomer (TPE) include, but are not limited to, styrenic block copolymers (TPS or TPE-s), thermoplastic olefin (TPO or TPE-o), thermoplastic vulcanizates (TPE-v or TPV), thermoplastic polyurethanes (TPU) and thermoplastic copolyester (TPC or TPE-E).

Examples of the ink affinitive material 12 suitable for use in this disclosure may include, but are not limited to, a thermoplastic polymer (such as polyethylene (PE), polypropylene (PP), polyvinyl chloride (PVC), polyethylene terephthalate (PET), acrylic, polyacrylonitrile (PAN) and nylon), a thermosetting polymer (such as polyurethane (PU)), a cellulose fiber (such as rayon, cellulose diacetate and cellulose triacetate) and combinations thereof. In an exemplary embodiment, the ink affinitive material 12 includes PU powder and PET fiber.

Example of the ink repulsive material 13 suitable for use in this disclosure may include, but is not limited to, a mineral material, such as glass, wood, calcium carbonate, mineral powder, clay, metal oxides (e.g., zinc oxide, titanium oxide), silica, quartz, mica, cement, lime, pozzolana, silica fume, kaolinite, talc, zeolites, bentonites, mineral carbon, magnesium carbonate, calcium sulfate, gypsum, carbon black, and graphite.

In certain embodiments, during step a, a chemical agent 14 is added to mix with the elastomeric material 11, the ink affinitive material 12 and the ink repulsive material 13.

The chemical agent 14 may include, but are not limited to, a dispersant (such as organic silicates, alkali metal phosphate, e.g., tris(2-ethylhexyl) phosphate, sodium dodecyl sulfate), 4-methyl-1-pentanol, cellulose derivatives, polyacrylamide, guar gum, polyethylene glycol fatty acid, polyether, organic silicone and silicone oil); a vulcanizing agent (such as sulfur and peroxide); an organic solvent (such as methylethyl ketone (MEK), dimethyl formamide (DMF), isopropyl alcohol (IPA), petroleum ether and toluene) and combinations thereof.

Figure 4:
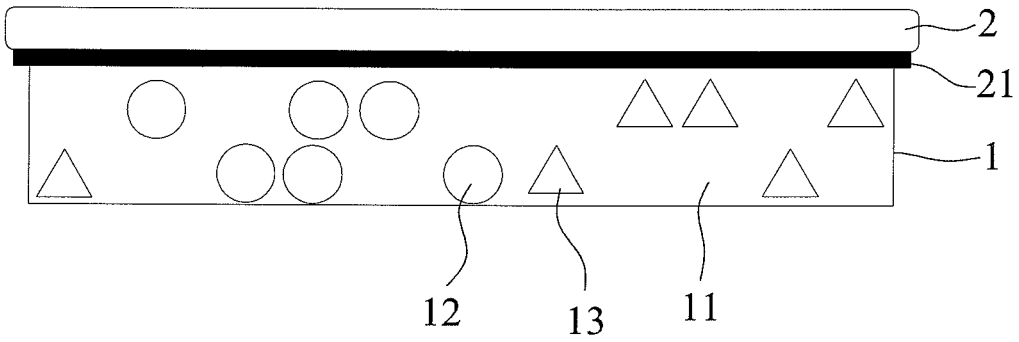

In step b, a sublimation transfer paper 2 that includes a sublimation ink 21 deposited thereon is disposed on the ink receiving sheet 1 (see FIG. 4). The sublimation ink 21 on the sublimation transfer paper 2 may exhibit colors, figures, patterns, characters and/or trademarks.

Figure 5:
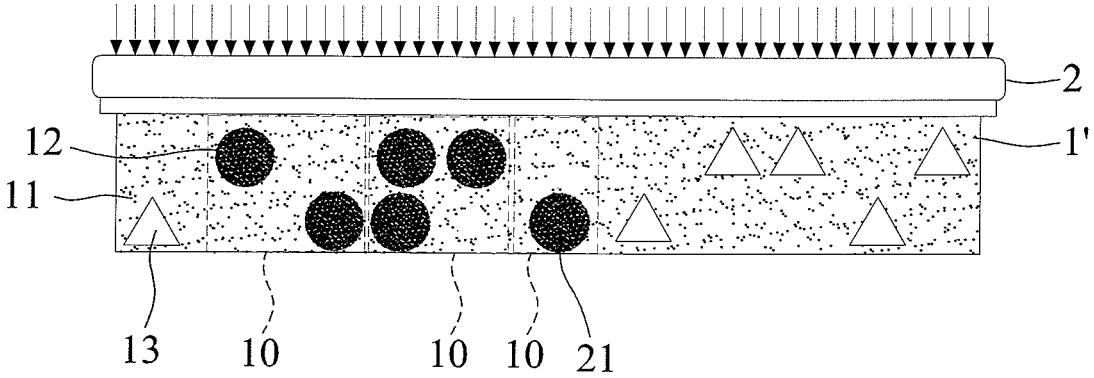

In step c, the sublimation transfer paper 2 on the ink receiving sheet 1 is subjected to a heat pressing process (see FIG. 5). The sublimation ink 21 is therefore released from the sublimation transfer paper 2, and permeates into the ink receiving sheet 1 so as to obtain a colored ink receiving sheet 1'. The concentration of the sublimation ink 21 in the ink affinitive material 12 is higher than that in the ink repulsive material 13. The colored ink receiving sheet 1' has a plurality of color indicating areas 10 that contains the ink affinitive material 12 and the sublimation ink 21 permeating into the ink affinitive material 12.

According to this disclosure, the elastomeric material 11, the ink affinitive material 12 and the ink repulsive material 13 may have different ink receiving capacity. In certain embodiments, the ink receiving capacity of the ink affinitive material 12 is higher than that of the ink repulsive material 13. The ink receiving capacity of the elastomeric material 11 may range between that of the ink affinitive material 12 and that of the ink repulsive material 13.

The heat pressing process may be conducted using a conventional hot press machine which applies predetermined high temperature and pressure for a predetermined period of time, so as to transfer the sublimation ink 21 from the sublimation transfer paper 2 to the ink receiving sheet 1.

To be specific, during the heat pressing process, the ink receiving sheet 1 is heated to expand the molecular structure thereof and to produce many clearances (i.e., the pores of the ink receiving sheet 12 would be opened), which results in the sublimation ink 21 permeating into the ink receiving sheet 1 and the majority of the sublimation ink 21 permeates into the ink affinitive material 12 and some of the sublimation ink 21 may permeate into the elastomeric material 11, while no or rarely small amount of the sublimation ink 21 permeates into the ink repulsive material 13.

It should be noted that the heat pressing conditions (e.g., temperature, pressure and time) may be adjusted depending on the types of the ink affinitive materials 12 applied, so as to obtain a desired printing effect. Typically, step c may be conducted at a temperature ranging between 100° C. and 300° C. The exemplified conditions with respect to the types of the ink affinitive materials 12 are listed in Table 1 below.

TABLE 1

| Types of the ink affinitive materials | Temperature (° C.) | Pressure (kg/cm) | Time (sec) |
|---|---|---|---|
| Polyester fabrics | 205-220 | 0.5 | 10-30 |
| Deformed low elasticity polyester fabric | 195-205 | 0.5 | 30 |
| Triacetate fabrics | 190-200 | 0.5 | 30-40 |
| Nylon fabrics | 195-205 | 0.5 | 30-40 |
| Acrylic fabrics | 200-210 | 0.5 | 30 |
| Diacetate fabrics | 185 | 0.5 | 15-20 |
| Polyacrylonitrile | 190-220 | 0.5 | 10-15 |

According to this disclosure, each of the color indicating areas 10 of the colored ink receiving sheet 1' independently has an ink intensity that is determined by a proportion of the ink affinitive material 12 into which the sublimation ink 21 permeates. That is, the color indicating area 10 that contains a higher proportion of the sublimation inks 21 permeating into the ink affinitive material 12 has a relatively higher ink intensity.

In certain embodiments, the sublimation transfer paper 2 includes a plurality of sublimation inks 21 with different colors, and thus each of the color indicating areas 10 of the colored ink receiving sheet 1' may have various colors to enhance an identification effect.

In other embodiments, the sublimation transfer paper 2 includes a plurality of sublimation inks 21 which are spaced apart from each other and having different colors, and thus one of the color indicating areas 10 of the colored ink receiving sheet 1' has a color different from that of another one of the color indicating areas 10.

Figure 6:
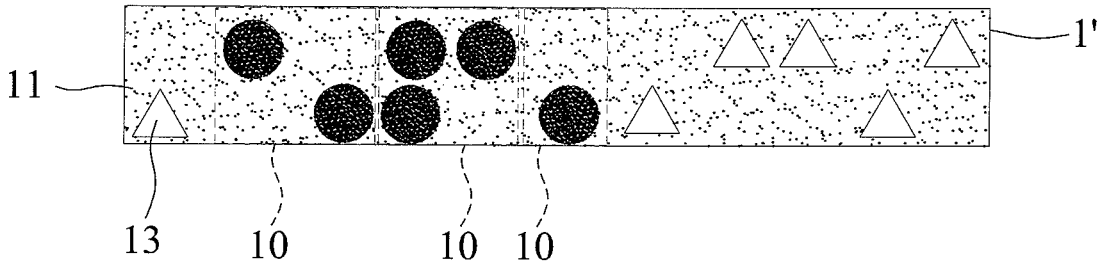

Referring to FIG. 6, in step d, the sublimation transfer paper 2 is removed from the colored ink receiving sheet 1' so as to obtain a wear and tear-indicating product.

According to this disclosure, the method may further include the step of molding the wear and tear-indicating product into a predetermined shape.

The predetermined shape of the wear and tear-indicating product may be designed according to actual needs. For example, the wear and tear-indicating product may be presented as an integral shape of a mat (available for yoga and the like), a tire (available for a vehicle and the like), a shoe sole, an oil seal, a rehabilitation tool, an electrical consumption member (available for a wireless transmitter, an RFID, an electric voltage device and the like), or a cell phone fitting (available for a cell phone shell, a cell phone frame, a cell phone ear plug and the like), etc.

In use, the wear and tear-indicating product may be worn and torn over time (i.e., aged) due to successive loss or damage (such as wear loss, wetting loss, oxidation loss, breakage loss, aging loss, fatigue loss, fading loss, heat loss and electrical loss, etc.), which is indicated by a change of the color(s) of the color indicating areas 10 (e.g., decreased of the ink intensity). Based on the loss (i.e., the extent of color change) of the wear and tear-indicating product, a user can effectively identify the extent of wear and tear of the product, and determine whether replacement of the wear and tear-indicating product is necessary.

The disclosure will be further described by way of the following examples and comparative example. However, it should be understood that the following examples and comparative example are solely intended for the purpose of illustration and should not be construed as limiting the disclosure in practice.

EXAMPLES

Example 1

A wear and tear-indicating product of Example 1 was manufactured as follows.

First, a blank was prepared using the components shown in Table 2. To be specific, SBR solution and PU solution were mixed in a high blending machine with a stirring speed of 3000 rpm/min at 25° C. After the resultant mixture was heated to a temperature of 60° C., PU powder was added into the high blending machine and heating was continued until the temperature reached to 75° C. Subsequently, PET fiber and clay were added to the high blending machine and heating was continued until the temperature reached 90° C., and then stirring was conducted at 90° C. for 2 hours, so as to obtain a blank. Afterwards, the blank was subjected to molding to form an ink receiving sheet.

TABLE 2

| Components | Parts by weight |
|---|---|
| Styrene butadiene rubber (SBR) solution (30 wt % of SBR dissolved in 70 wt % of a mixture of petroleum ether and toluene) | 100 |
| Polyurethane (PU) solution (30 wt % of PU dissolved in 70 wt % of a mixture of methylethyl ketone (MEK) and dimethyl formamide (DMF)) | 20 |
| PU powder | 30 |
| PET fiber | 15 |
| Clay | 30 |

A sublimation transfer paper that contains PU ink deposited thereon was placed on the ink receiving sheet, and then subjected to a heat pressing process at a temperature ranging from 205° C. to 220° C. and a pressure of 0.5 kg/cm for 10 seconds to 30 seconds. The PU ink was therefore released from the sublimation transfer paper, and permeated into the ink receiving sheet so as to obtain a colored ink receiving sheet. The amount of the PU ink permeating into PU and PET of the blank are higher than that permeates into clay, so that a plurality of color indicating areas that contains PU and PET and the PU ink were formed within the colored ink receiving sheet.

The sublimation transfer paper was removed from the colored ink receiving sheet, so as to obtain the wear and tear-indicating product.

Example 2

The wear and tear-indicating product of Example 2 was manufactured using the components shown in Table 3 and by procedures similar to those of Example 1, except that all of these components were simultaneously mixed in a Banbury mixer under stirring at 90° C. and then vulcanized for 15 minutes, followed by cooling to obtain the blank.

TABLE 3

| Components | Parts by weight |
|---|---|
| SBR (solid) | 100 |
| PU powder | 25 |
| PET fiber | 20 |
| Clay | 30 |
| ZnO | 5 |
| Sulfur | 2 |
| Peroxide | 1 |

Although the disclosure has been explained in relation to its preferred embodiment(s) as mentioned above, it is to be understood that many other possible modifications and variations can be made without departing from the scope of the present disclosure. It is, therefore, contemplated that the appended claim or claims will cover such modifications and variations that fall within the true scope of the disclosure.

What is claimed is:

1. A method for manufacturing a wear and tear-indicating product, comprising:

mixing a material component, an ink affinitive material and an ink repulsive material under stirring to form a blank, followed by molding the blank, so as to obtain an ink receiving sheet, wherein a plurality of color indicating areas are formed on the ink receiving sheet, at least one area of the plurality of color indicating areas comprises a higher proportion of the ink affinitive material per unit volume of the ink receiving sheet than a neighboring area of the at least one area of the plurality of color indicating areas;

disposing a sublimation transfer paper on the ink receiving sheet, the sublimation transfer paper including a sublimation ink deposited thereon;

heat pressing the sublimation transfer paper on the ink receiving sheet, so that the sublimation ink is released from the sublimation transfer paper, and permeates into the ink receiving sheet so that the sublimation ink is adhered to the material component and the ink affinitive material, so as to obtain a colored ink receiving sheet, the colored ink receiving sheet having a plurality of color indicating areas that contain the ink affinitive material and the sublimation ink permeating into the ink affinitive material; and removing the sublimation transfer paper from the colored ink receiving sheet so as to obtain the wear and tear-indicating product.

2. The method for manufacturing a wear and tear-indicating product as claimed in claim 1, wherein the material component is an elastomeric material selected from the group consisting of ethylene-vinyl acetate (EVA), styrenic block copolymers (TPS or TPE-s) and thermoplastic polyurethanes (TPU).

3. The method for manufacturing a wear and tear-indicating product as claimed in claim 1, wherein the ink affinitive material is selected from a group consisting of polyethylene terephthalate (PET), polyacrylonitrile (PAN), nylon, polyurethane (PU), rayon, cellulose diacetate and cellulose triacetate.

4. The method for manufacturing a wear and tear-indicating product as claimed in claim 1, wherein, during the mixing step, a chemical agent is added to mix with the material component, the ink affinitive material and the ink repulsive material.

5. The method for manufacturing a wear and tear-indicating product as claimed in claim 4, wherein the chemical agent is selected from a group consisting of a dispersant, methylethyl ketone (MEK), dimethyl formamide (DMF), isopropyl alcohol (IPA) and combinations thereof.

6. The method for manufacturing a wear and tear-indicating product as claimed in claim 1, wherein each of the color indicating areas of the colored ink receiving sheet independently has an ink intensity that is determined by a proportion of the ink affinitive material into which the sublimation ink permeates.

7. The method for manufacturing a wear and tear-indicating product as claimed in claim 6, wherein the sublimation transfer paper includes a plurality of sublimation inks with different colors, and each of the color indicating areas of the colored ink receiving sheet has a single color or different colors to enhance an identification effect.

8. The method for manufacturing a wear and tear-indicating product as claimed in claim 1, wherein the step of heat pressing the sublimation transfer paper on the ink receiving sheet is conducted at a temperature ranging between 205° C. and 300° C.

9. The method for manufacturing a wear and tear-indicating product as claimed in claim 1, further comprising molding the wear and tear-indicating product into a predetermined shape.

10. The method for manufacturing a wear and tear-indicating product as claimed in claim 9, wherein the predetermined shape of the colored ink receiving sheet is presented as one of an integral shape of a mat, a tire, a shoe sole, an oil seal and a cellphone fitting.

11. The method for manufacturing a wear and tear-indicating product as claimed in claim 1, wherein the ink repulsive material is selected from a group consisting of wood, quartz, cement, lime, pozzolana, silica fume, kaolinite, zeolites, bentonites, mineral carbon, magnesium carbonate, calcium sulfate, gypsum and graphite.

12. A method for manufacturing a wear and tear-indicating product, comprising:

mixing a material component, an ink affinitive material and an ink repulsive material under stirring to form a blank, followed by molding the blank, so as to obtain an ink receiving sheet, wherein a plurality of color indicating areas are formed on the ink receiving sheet, at least one area of the plurality of color indicating areas comprises a higher proportion of the ink affinitive material than a neighboring area of the at least one area of the plurality of color indicating areas;

disposing a sublimation transfer paper on the ink receiving sheet, the sublimation transfer paper including a sublimation ink deposited thereon;

heat pressing the sublimation transfer paper on the ink receiving sheet, so that the sublimation ink is released from the sublimation transfer paper, and permeates into the ink receiving sheet so that the sublimation ink is adhered to the material component and the ink affinitive material, so as to obtain a colored ink receiving sheet, the colored ink receiving sheet having a plurality of color indicating areas that contain the ink affinitive material and the sublimation ink permeating into the ink affinitive material; and removing the sublimation transfer paper from the colored ink receiving sheet so as to obtain the wear and tear-indicating product;

wherein the at least one area of the plurality of color indicating areas has a higher ink intensity than the neighboring area of the at least one area of the plurality of color indicating areas.

* * * * *